US006991442B2

(12) United States Patent
Meguro

(10) Patent No.: US 6,991,442 B2
(45) Date of Patent: Jan. 31, 2006

(54) GEAR PUMP AND METHOD OF MAKING SAME

(75) Inventor: Katsuji Meguro, Kakegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 8 days.

(21) Appl. No.: 10/605,175

(22) Filed: Sep. 12, 2003

(65) Prior Publication Data

US 2004/0105771 A1 Jun. 3, 2004

(30) Foreign Application Priority Data

Oct. 28, 2002 (JP) ..... 2002-313413

(51) Int. Cl.
*F01C 17/00* (2006.01)

(52) U.S. Cl. ..... 418/182; 418/206.1; 418/206.4

(58) Field of Classification Search ..... 418/182, 418/206.1, 206.4
See application file for complete search history.

(56) References Cited

U.S. PATENT DOCUMENTS 1,541,435 A * 6/1925 Reller ..... 418/182
2,655,108 A * 10/1953 Osborne ..... 418/206.4
3,263,425 A * 8/1966 Rohde ..... 418/206.1
3,286,643 A * 11/1966 Andrews et al. ..... 418/206.1
3,704,968 A * 12/1972 Haupt ..... 418/182
5,791,143 A * 8/1998 Glomeau ..... 60/476
6,210,138 B1 * 4/2001 Cortez ..... 418/206.1

FOREIGN PATENT DOCUMENTS

AT 183311 * 9/1955 ..... 418/206
GB 265576 * 8/1927 ..... 418/182
JP 08-93653 8/1996

* cited by examiner

*Primary Examiner*—Theresa Trieu
(74) *Attorney, Agent, or Firm*—Ernest A. Beutler

(57) ABSTRACT

An improved high pressure intermeshing gear pump that achieves high efficiency and a low cost by forming the pumping cavity such that no fillets exist at the corners permitting closed fits without utilizing bearing end plates. In addition an improved coupling between the gears and their supporting shafts is disclosed as is a simplified machining method that eliminates burrs that may be formed during the drilling operations.

14 Claims, 6 Drawing Sheets

GEAR PUMP AND METHOD OF MAKING SAME

BACKGROUND OF INVENTION

This invention relates to an improved gear pump and method of making such a pump.

As is well known, gear pumps are widely used for a great variety of purposes. This is due to their ability to generate high pressures. Also these pumps generally have a compact size and shape.

In one commonly utilized type of gear pump there are a pair of intermeshing gears that are supported for rotation about parallel axes. These gears are positioned within a pumping cavity formed by a pump housing. The pump housing cavity has a generally figure 8 shape and is closed by end walls that are in confronting relationship to the flat end faces of the gears. Passages permit the flow of the pumped fluid to and from the space between the gears. Because of machining problems with the prior art type of pumps and their manufacturing methods it has been the practice to interpose bearing end plates between the gear end faces and the pump housing.

For example, published Japanese Patent Application Hei 08-93653 shows a typical prior art pump of this type. The pump main housing member is formed with the pumping chamber by a machining operation through one end face thereof. At the bottom of this cavity, a fillet will be formed of machining necessity. Thus the peripheral edge of the gears must be spaced from this projecting area of the pump housing to avoid interference. This spacing can and is accomplished in part by chamfering the edges of the gear teeth. This however leaves a void area where leakage of the pumped fluid will occur and thus the efficiency of the pump is decreased.

The amount of chamfering required can be reduced by utilizing bearing end plates that engage the flat ends of the gears as shown in FIG. 3 of the noted published Japanese Patent Application. However that adds to the size and cost of the pump. In addition the end plates themselves introduce clearances and areas where leakage can and does occur.

It is, therefore, a principle object of this invention to provide an improved, simplified pump construction and pump manufacturing methodology.

It is a further object of this invention to provide an improved, pump construction and pump manufacturing methodology that offers higher efficiencies and more compact construction than heretofore possible.

In the pumps of this type the gears are supported by gear shafts and at least one of these shafts is driven by some form of prime mover. The gears are expensive to manufacture and are formed from special materials. If they are made integrally with their shafts, as is common practice, the cost increases and the manufacturing can become more difficult. However if the shafts are made separate from the gears, a driving connection must be made to at least the driven gear. This normally is done by a key or pin connection. Those commonly used are costly and troublesome.

It is therefore a further object of this invention to provide a simplified and low cost way of coupling a pump gear and its shaft.

SUMMARY OF INVENTION

A first feature of the invention is adapted to be embodied in an intermeshing gear pump. The pump is comprised of an outer housing defining a pumping cavity in which a pair of intermeshing gears are journalled for pumping a fluid from a fluid inlet to the pumping cavity to a pumping outlet from the pumping cavity. The intermeshing gears have end faces at opposite sides of the gears extending perpendicularly to the rotational axes of the gears. The outer housing is comprised of a main body part and a pair of separate end plates affixed thereto. The main body part has an opening extending axially therethrough that defines a portion of the pumping cavity that faces the circumferential peripheral surfaces of the gears. The end plates each closing a respective side of the main body part opening and are in confronting relation to respective of the gear end faces for closing the pumping chamber. A fastener arrangement affixes the end plates and the main body part together.

A further feature of the invention is also adapted to be embodied in an intermeshing gear pump. In accordance with this feature, the pump is comprised of an outer housing defining a pumping cavity in which a pair of intermeshing gears are journalled for pumping a fluid from a fluid inlet to the pumping cavity to a pumping outlet from the pumping cavity. The intermeshing gears have end faces extending perpendicularly to the rotational axes of the gears at at least one side of the gears. The outer housing is comprised of a main body part defining at least in part the pumping cavity and an end plate affixed thereto and closing the pumping cavity. At least one of the gears forms a bore extending therethrough to receive a shaft. The end face of this one gear forms a slot extending perpendicularly to the bore of the gear. A coupling pin extends through the shaft and has at least one end portion received in the slot for non-rotatably coupling the shaft and the one gear.

Yet another feature of the invention is adapted to be embodied in a method of forming an intermeshing gear pump. The pump is comprised of an outer housing defining a pumping cavity in which a pair of intermeshing gears are journalled on respective shafts for pumping a fluid from a fluid inlet to the pumping cavity to a pumping outlet from the pumping cavity. The intermeshing gears having end faces extending perpendicularly to the rotational axes of the gears at opposite sides of the gears. The outer housing comprises a main body part and at least one separate end plate affixed thereto. The main body part has an opening extending axially therein that defines a portion of the pumping cavity facing the circumferential peripheral surfaces of the gears. The end plate closes a respective side of the main body part opening. A fastener arrangement affixes the end plate and the main body part together. The method comprising the steps of placing a pair of plates in abutting relationship. The abutting plates are held against transverse movement relative to each other. A pair of holes are drilled through the plates from one side of one of the plates and ending through the oppositely facing side of the other of the plates so that any burrs formed by the drilling operation will be formed on the oppositely facing side of the other of the plates. Then a cavity is machined in at least the oppositely facing side of the other of the plates of sufficient size to form the pumping cavity and in an area encompassing that of the previously drilled holes to remove any burrs formed by the drilling operation and form the main body part. Then the one plate is placed and affixed against the main body part in closing relation to the pumping cavity formed therein to form the end plate therefor.

DETAILED DESCRIPTION

Figure 1:
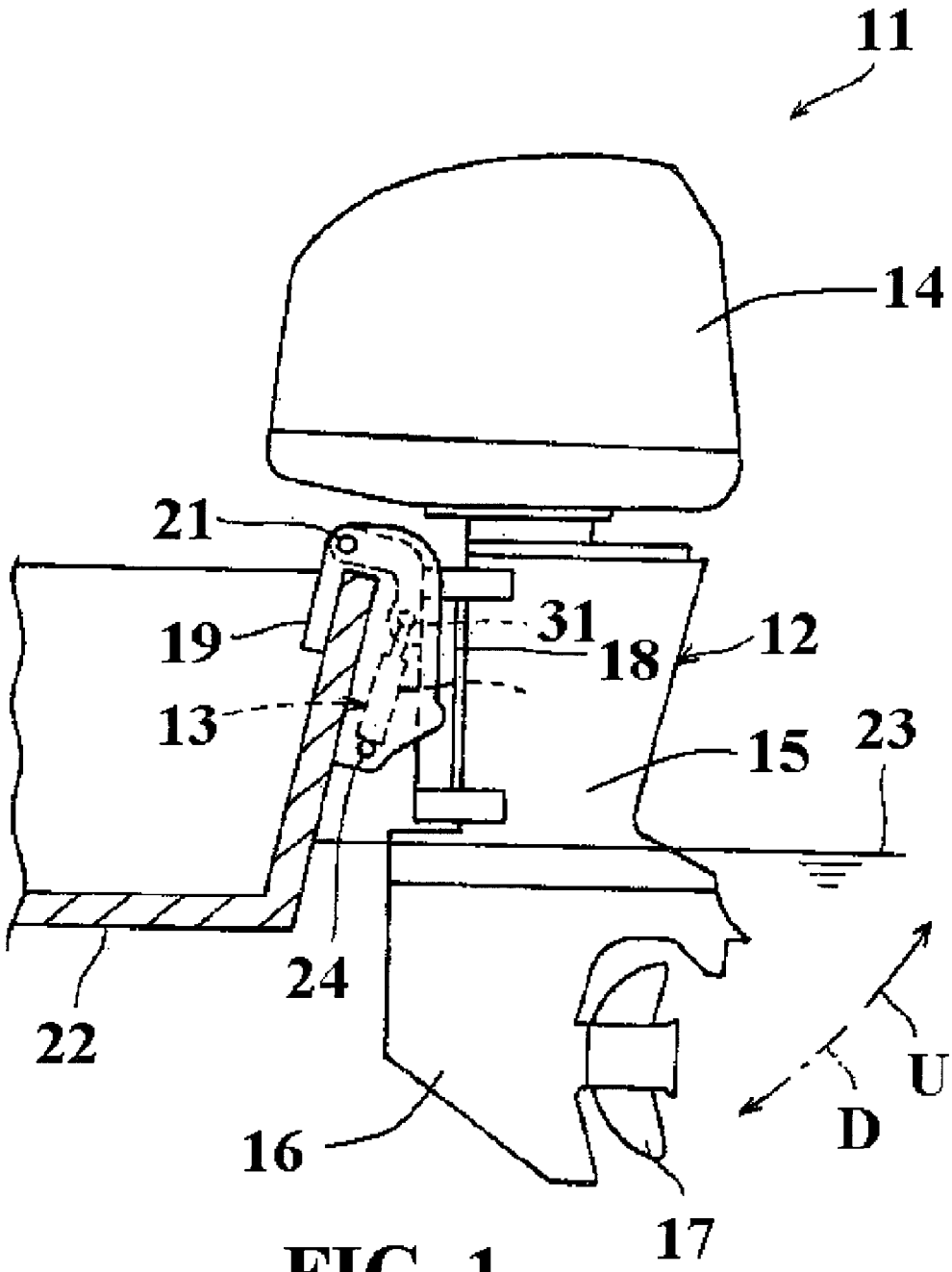
FIG. 1 is a side elevational view of a marine propulsion unit having a tilt and trim unit powered by a fluid pump embodying the invention and manufactured in accordance with the invention which propulsion unit is shown attached to the transom of a watercraft hull, shown partially and in section.
Figure 2:
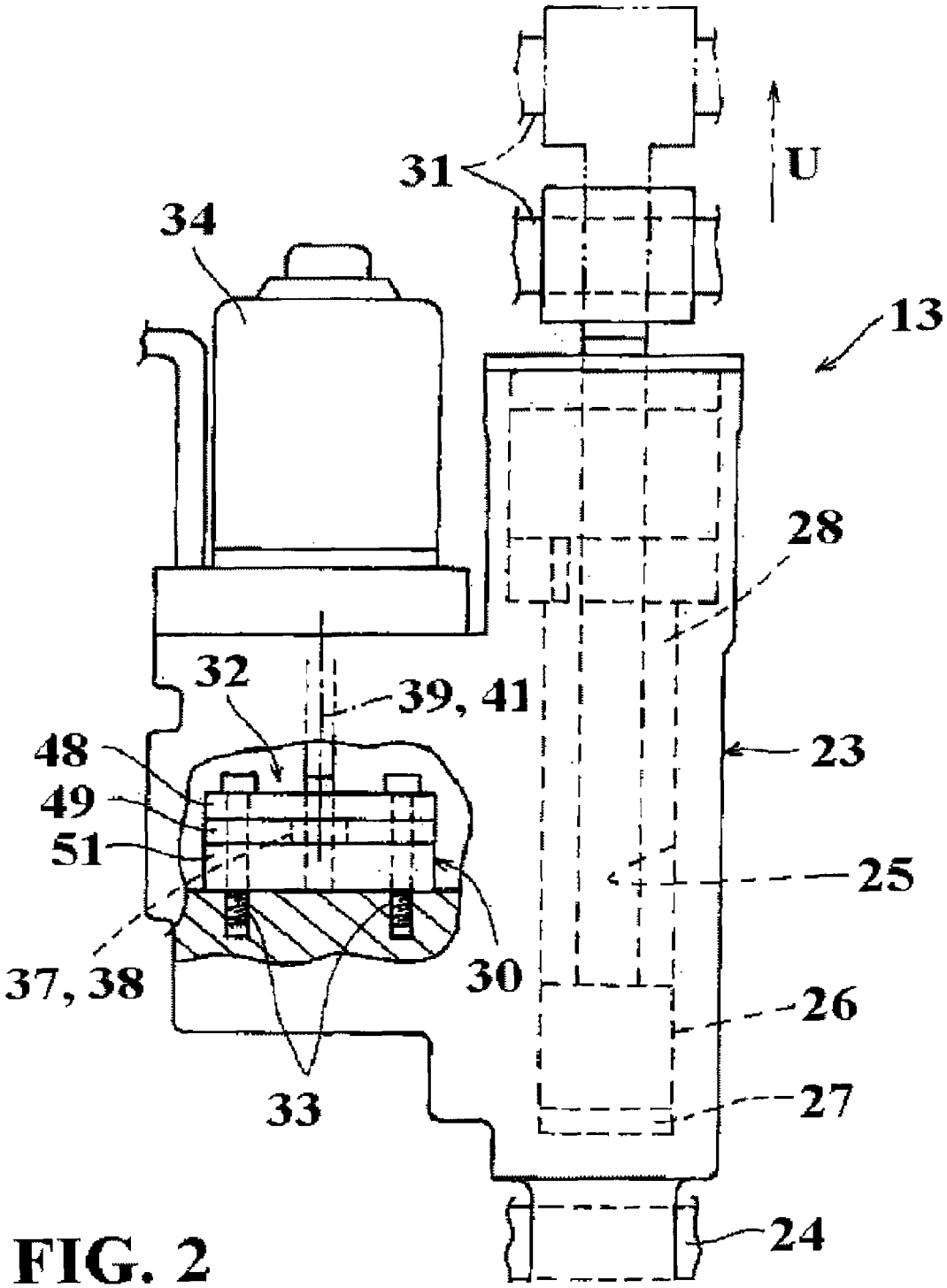
FIG. 2 is an enlarged elevational view of the tilt and trim unit broken away to show the pump.

Referring now in detail to the drawings, FIGS. 1 and 2 show a marine propulsion system, indicated generally by the reference numeral 11, as this is a typical, but not the only, use of the invention. In the illustrated embodiment, the propulsion system 11 is comprised of an outboard motor 12 and a hydraulically operated tilt and trim unit 13, that is shown in most detail in FIG. 2.

Referring now to FIG. 1, the outboard motor 12 is comprised of a power head 14 that contains a powering internal combustion engine that is not shown because of its containment in a surrounding protective cowling. The engine drives a drive shaft (not shown) that is journalled in a drive shaft housing 15 and into a lower unit 16 where it drives a propulsion device such as a propeller 17.

The drive shaft housing 15 is connected to a steering shaft (not shown) that is journalled for steering movement about a generally vertically extending axis in a swivel bracket 18 in a manner well known in the art. The swivel bracket 18 is pivotally connected to a clamping bracket 19 by a pivot pin 21, in a manner that is also well known in the art. The clamping bracket 19 is suitably connected to the transom of a watercraft hull 22, operating in a body of water 23.

Except for its powering pump, to be described shortly, the function and operation of the tilt and trim unit 13 is as well known in the art to trim or tilt the outboard motor 12 up in the direction of the arrow U or down in the direction of the arrow D. In addition the tilt and trim unit 13 may function as a shock absorber to permit the outboard motor 12 to "pop up" when an underwater obstacle is met and to return to the trim adjusted position when it is cleared.

Referring now primarily to FIG. 2, the tilt and trim unit 13 is comprised of a hydraulic cylinder housing, indicated generally at 23, having one end pivotally connected to the clamping bracket 19 on the hull 22 by a pivot shaft 24. The cylinder housing 23 forms a cylinder bore 25 that is divided by a piston 26 into first and second pressure oil chambers 27 and 28. A piston rod 29 is fixed to the piston 26 and extends through the chamber 28 and out of the cylinder housing 23 where it is connected by a pivot shaft 31 to the swivel bracket 18. By pressurizing the chamber 27 and exhausting the chamber 28 the outboard motor 12 will move for upward tilting action U. Conversely pressurizing the second pressure oil chamber 28 and exhausting the chamber 27 will effect the outboard motor 12 to move downward for returning action D. The construction and operation of the unit 13 is well known in the art and thus further description except for its pump, next to be described, is not believed necessary. This is particularly true since the use of the pump is not so limited.

The pump, indicated generally by the reference numeral 32, comprises an intermeshing gear pump supported by threaded fasteners 33 on the cylinder 23, a reversible electric motor 34 for driving the gear pump 32, and, indicated generally at 35 for introducing oil which is a pressurized fluid delivered from the gear pump 32 driven by the electric motor 34 into the cylinder 23.

Figure 3:
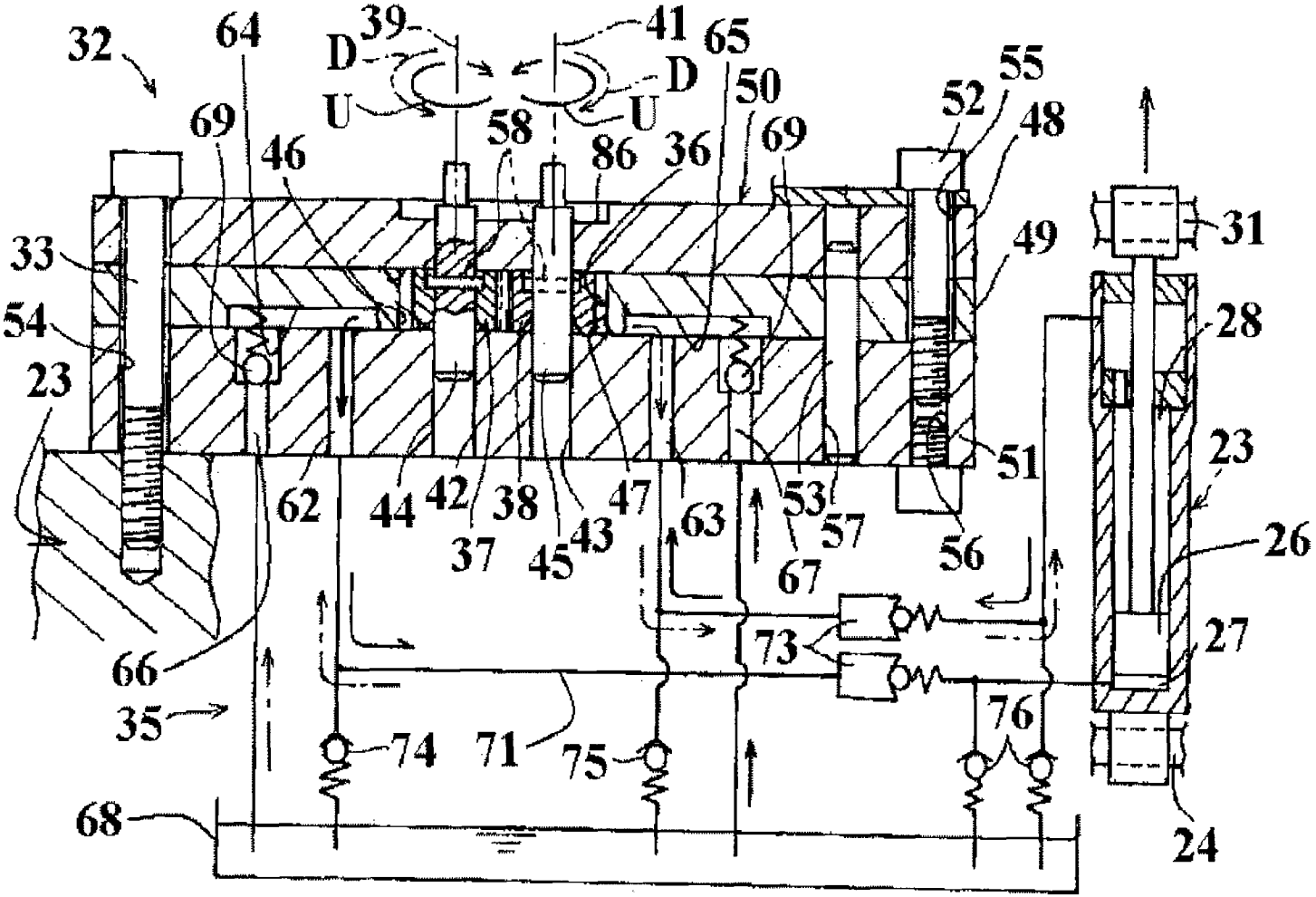
FIG. 3 is a cross sectional view of the pump taken through the gear axes.
Figure 4:
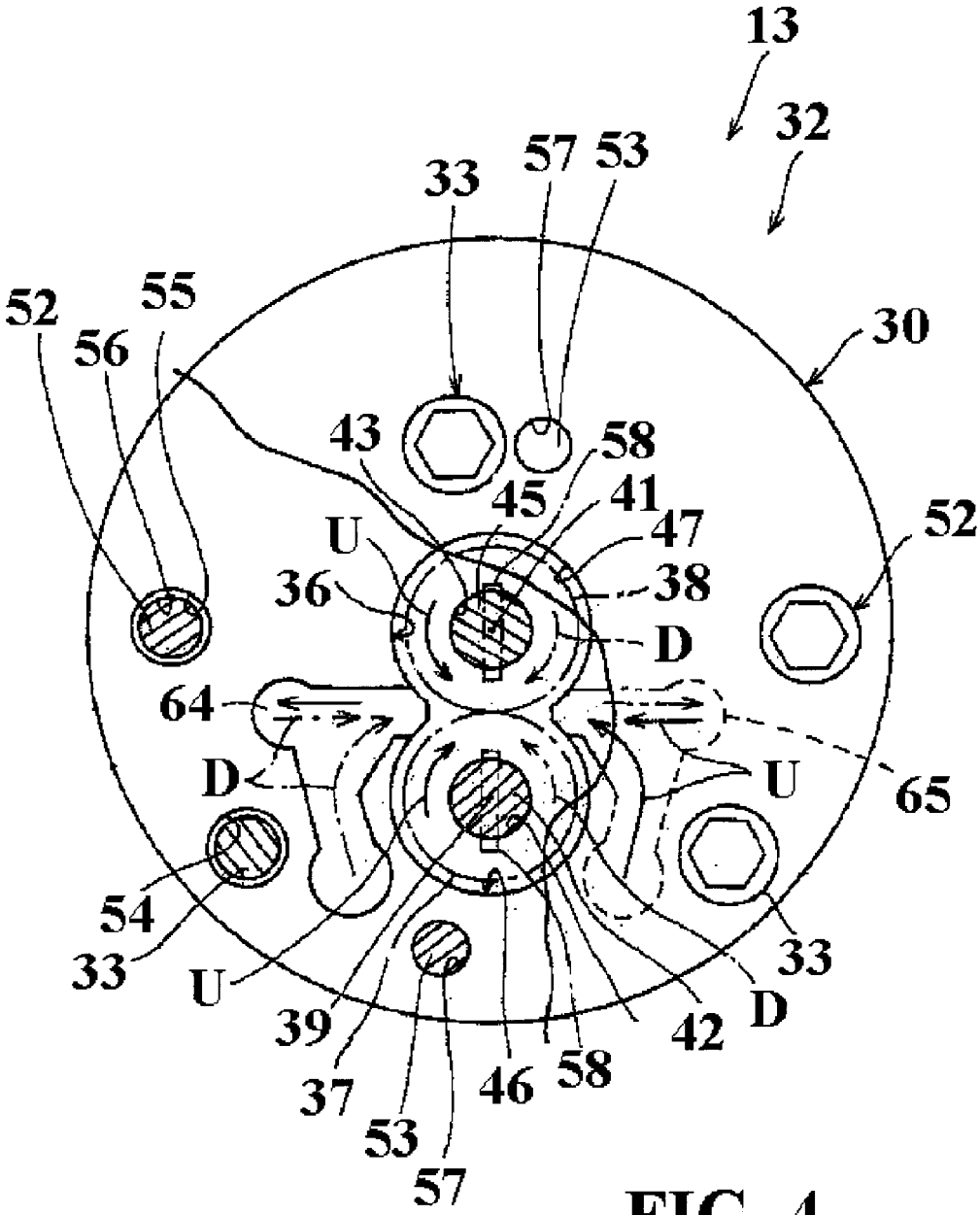
FIG. 4 is a top plan view of the pump with a portion of the top cover broken away to more clearly show the construction.
Figure 5:
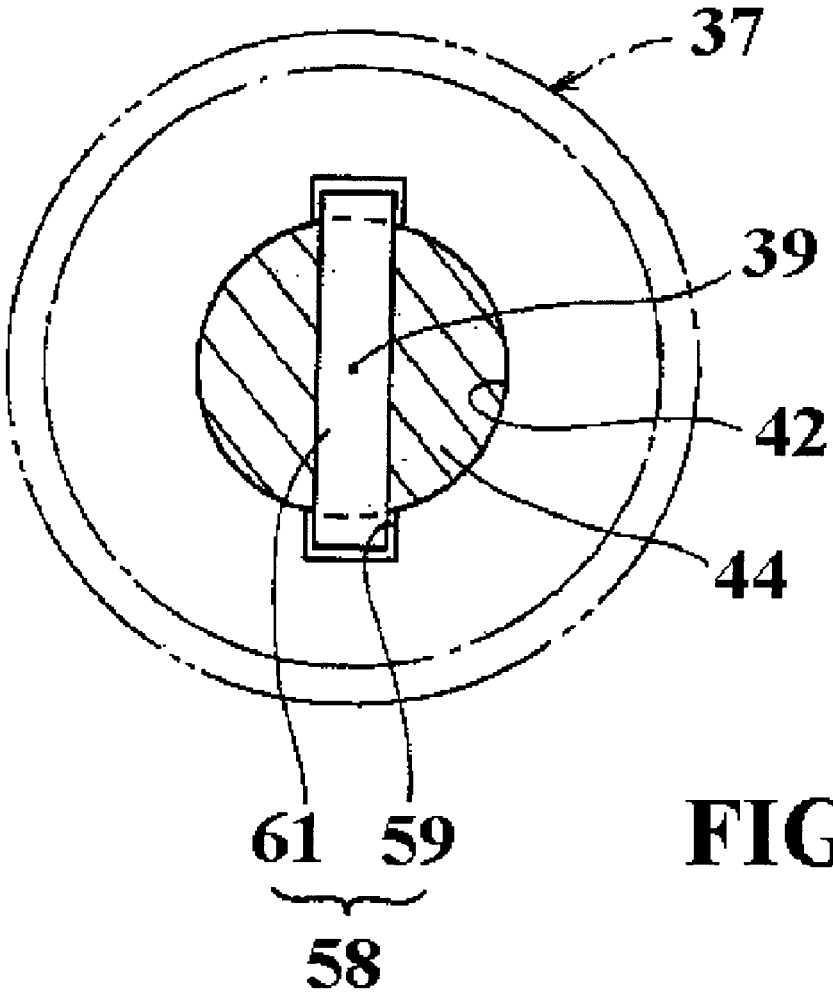
FIG. 5 is an enlarged view looking in the same direction as FIG. 4 but showing only the connection between one of the pump gears and its shaft.

The gear pump 32 is supported by the threaded fasteners 33 on the cylinder 23 and comprises a housing assembly 30, made of an iron-based sintered metal, constituting the outer shell of the gear pump and defining a pumping cavity, indicated generally by the reference numeral 36, see now additionally FIGS. 3–5. A pair of spur gears 37, 38 are contained in the pumping cavity 36 with their axial centers 39, 41 disposed parallel, and meshing with each other. Shaft receiving holes 42, 43 are formed in the housing assembly 30 and the gears 37, 38 on the axial centers 39, 41. Supporting shafts 44, 45 are inserted in these shaft holes 42, 43 and journalled at both ends on the housing assembly 30 for supporting these gears 37, 38 for rotation about the axial centers 39, 41. At least either one of these supporting shafts 44, 45 is driveably connected to the reversible electric motor 34. The gears 37, 38 are of the same shape and the same size and their flat end faces are flush with each other.

The internal surface of the pumping cavity 36 is formed by a pair of inside cylindrical surfaces 46, 47 that extend parallel to the axial centers 39, 41 and directly face the two gears 37, 38 in close proximity to the outside surfaces thereof. This forms a generally figure 8 shaped recess facing directly the outside circumferential surfaces of the two gears 37, 38 in close proximity thereto.

The housing assembly 30 is made up of first, second and third pieces 48, 49, 51, each of a flat plate-like shape. These pieces 48, 49 and 51 are stacked together in this order in direct contact with the piece 49 forming the main pump body and the pieces 48 and 49 forming upper and lower end closures therefore. Threaded fasteners 52 detachably fix these first, second and third pieces 48, 49, 51 together. However locating pins 53 position the first, second and third pieces 48, 49, 51 to each other prior to the fixing by the threaded fasteners 52. In addition the threaded fasteners 33 fix the first, second and third pieces 48, 49, 51 together when the gear pump 32 is supported on the cylinder 23, and thus have the same function as the threaded fasteners 52.

The threaded fasteners 33 pass through holes 54 provided through the housing assembly 30 parallel to the axial centers 39, 41 and are screwed into taped openings formed in the cylinder 23. In a similar manner the threaded fasteners 52 pass through holes 55 provided through the first and second pieces 48, 49 parallel to the axial centers 39, 41, and are received in tapped openings 56 formed in the third piece.

The locating pins 53 are positioned in aligning holes 57 provided in the first, second and third pieces 48, 49, 51 be parallel to the axial centers 39, 41. As already noted and insertion of the locating pins 53 into the aligning holes 57 allows the first, second and third pieces 48, 49, 51 to be positioned accurately to each other.

A coupling device, indicated generally at 58, is provided for coupling the gears 37, 38 and the respective support shafts 44, 45 so that the gears 37, 38 rotate with the support shafts 44, 45, respectively. The coupling means 58 is shown best in FIG. 5 and comprises coupling grooves 59 formed on one flat face of the gears 37, 38 adjacent the housing piece 48. Theses grooves 59 receive the ends of coupling pins 61 that penetrating radially through suitable openings formed in the support shafts 44, 45. The pins 61 are inserted in the coupling grooves 59 with a small play in a clearance-fit relation.

As shown in FIG. 3, the lower ends of the shafts 44 and 45 and the upper ends of the shaft holes 42 and 43 are chamfered significantly to facilitate assembly.

Referring now primarily to FIG. 3 and also FIG. 4, the oil introducing device and reservoir 35 comprises a pair of oil passages 62 and 63 are formed in lower end plate 51 of the housing assembly 30. The oil passage 62 allows the area of one of two portions of the pumping cavity 36 formed on both sides of the mutual meshing portion of the gears 37, 38 to communicate with the outside of the housing assembly 30. The other oil passage 63 allows the other of two portions of the pumping cavity 36 to comumunicate with the outside of the housing assembly 30. The passages 62 and 63 communicate with these portions of the pumping cavity 36 through recesses 64 and 65, respectively, formed in the lower face of the main housing portion 49.

In addition to the oil passages 62 and 63. the oil introducing device 35 comprises still another two oil passages 66 and 67 for providing communication of the recesses 64 and 65 with a reservoir 68 of the device 35. Ball type check valves 69 in enlargements of the lower end plate passages 66 and 67 permit the drawing of make up fluid from the reservoir 68.

The passage 62 communicates with the chamber 27 of the cylinder 23 through a conduit 71 which is external of the pump housing 50. In a like manner the passage 63 communicates externally with the cylinder chamber 28 through a conduit 72. As is well known in the art, shuttle valves 73 are provided in the passages 71 and 72 to permit reverse flow. Pressure relief valves 74 and 75 are provided in the conduits 71 and 72 respectively for limiting the maximum pressure exerted in the cylinder chambers 27 and 28, respectively. There are also provided a pair of pressure relief valves 76 between the shuttle valves 73 and the reservoir 68 for a similar purpose.

As seen in FIGS. 3 and 4, when the electric motor 34 is operated in the trim up direction to rotate the gears 37, 38 in the trim up directions U, respectively, remembering that the gears 37, 38 are rotated the opposite directions due to their intermeshing relationship, pressure oil is delivered from the gear pump 32 passages 64 and 62. This pressurized oil is supplied to the first pressure oil chamber 27 of the cylinder 23 through the oil introducing device 35, as shown in these figures by the solid lines, so that the cylinder 23 extends to move the outboard motor 12 for upward tilting action U. Since the external circuitry is well known in the art it is not believed necessary to describe its operation any further. It should also be remembered that this environment is only one of many possible uses for the pump 32.

On the other hand, when the electric motor 34 is operated in the reverse direction to rotate the gears 37, 38 in the reverse directions D, respectively (gears 37, 38 are rotated reversely in the directions opposite to those of the previous case), pressure oil delivered from the gear pump 32 is supplied to the second pressure oil chamber 28 of the cylinder 23 through the oil introducing device 35, as shown in FIGS. 1 and 4 by single dot and dash lines, so that the cylinder contracts to move the outboard motor 12 for downward returning action D. Again, since the external circuitry is well known in the art it is not believed necessary to describe its operation any further.

Figure 6:
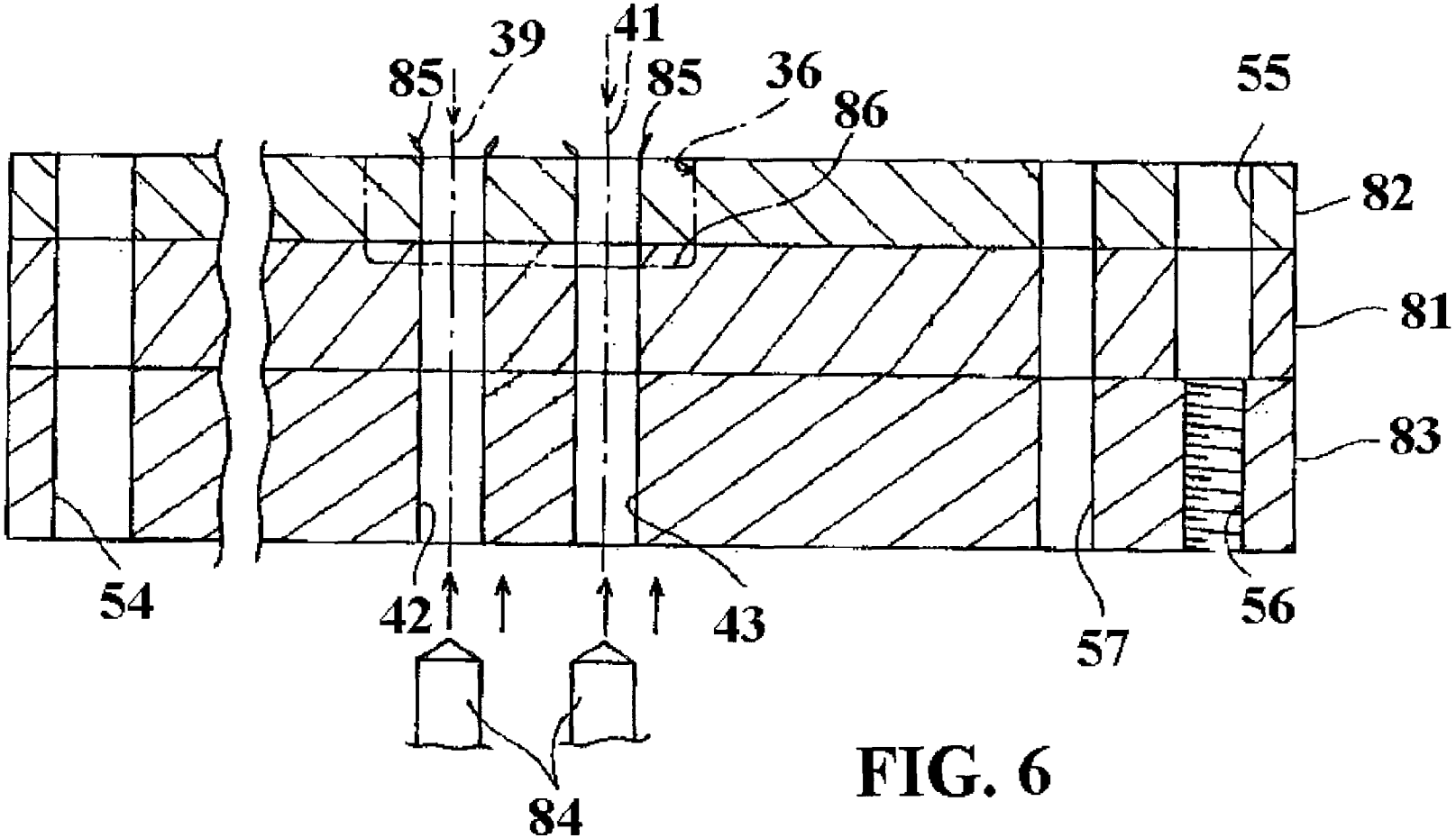
FIG. 6 is a cross sectional view taken along the same plane as FIG. 3, but showing a phase of the manufacturing process.

Next, by principal reference to FIG. 6, which should also be compared to FIG. 3, a method of forming the gear pump 32 will be described, as this constitutes an important feature of the invention. In FIG. 6, work pieces that will eventually become the main body housing 49, and the upper and lower end closures 48 and 51. These work pieces before machining are indicated in FIG. 6 by the reference numerals 81, 82 and 83, respectively. That is the work piece 81 will become after machining the main body housing 49 and the work pieces 82 and 83 will become the upper and lower end closures, respectively.

First, second and third work pieces 81, 82, 83 are formed each having the same thickness and size as the respective final housing pieces 48, 49, 51. However, for reasons that will shortly become apparent, the work pieces are initially stacked and retained in an order different from their final assembled positions. They are stacked together in the order of the second, the first and the third work pieces 82, 81, 83 in direct contact and fixed together by a suitable mechanism.

Then, the shaft holes 42, 43 are machined with a tool such as a pair of drills 84 from the lower side of the third work piece 83 through the first work piece 81 toward the upper side of the second work piece 82. In this case, when the shaft holes 42, 43 are drilled in the second work piece 82, burrs indicated at 85 are normally produced at the edges of the holes on the ending side of the drilling operation. However, the shaft holes 42, 43 are not necessarily machined through the upper side of the second work piece 82 to practice the invention.

Then, in the second work piece 82 is machined, with another cutting tool to form thepumping cavity 36 having a constant cross-sectional shape in the direction of depth, through the entire thickness of the second work piece 82. This machining is preferably continued into the first work piece 81 on the side adjacent the second work piece 82 to form a recess 86 of the same cross-section in shape and size as the pumping cavity 36 but preferably of lesser axial length. In this case, the burrs 85 are automatically eliminated in association with the formation of the pumping cavity 36.

The bolt through holes 54 andlocating pin holes 57 are formed in the first, second and third work pieces 81, 82, 83 to form the first, second and third pieces 48, 49, 51. These pieces are then separated to perform the threading operation in the piece 83 and the oil passage drilling operation and such other machining in the main body work piece 82 and lower end closure work piece 83 as required.

Then the resulting pump pieces are rearranged in their final order. After that, the gears 37, 38, support shafts 44, 45, coupling means 58 and knock pins 56 are incorporated in these pieces and then the first, second and third pieces 48, 49, 51 are put together directly in this order and fixed with the threaded fasteners 52. The formation of the gear pump 32 is thereby completed.

Because of this arrangement, the inside surfaces 46, 47 of the pumping cavity 36 face directly the outside surfaces of the gears 37, 38. As previously noted, in the prior art, sliding plates are provided between the end faces of the gears 37, 38 and the inside surfaces 46, 47 of the pumping cavity 36. That is not necessary here since no fillet results at the bottom of the pumping cavity 36. Therefore in this invention, the size of the housing assembly 30 can be decreased, that is, the size of the gear pump 32 can be decreased.

Therefore, in forming the housing assembly 30, a hole having the same cross-section in shape and size as the pumping cavity 36 when viewed in the direction of the axial centers 39, 41 is first machined through a flat plate member of the same thickness as the second piece 49 to form the second piece 49. Then the first, second and third pieces 48, 49, 51 are put together in this order, so that the inside surfaces 46, 47 of the pumping cavity 36 are defined by the first and third pieces 48, 51, and the inside circumferential surface 38 of the pumping cavity 36 by the second piece 49, that is, the piece 30 containing the pumping cavity 36 is formed.

In this case, it can be ensured more reliably in association with the formation of the pumping cavity 36 that corners of the opening ends of the pumping cavity 36 open to the outsides from the second piece 49 are shaped to be right angular. Therefore, the corners of the pumping cavity 36 defined by the inner surfaces 46, 47 and the inside circumferential surface 38 can be each formed into a right angular shape more reliably. Thus, if the peripheral corners of the gears 37, 38 are shaped to be right angular and the inside corners and the peripheral corners are fitted together, clearances between the peripheral corners and the inside corners can be significantly decreased compared with when they are shaped in arcs and fitted together.

Therefore, partial return of pressure oil from the delivery side to the suction side through the foregoing clearances in the prior art constructions is prevented. Thus during operation of the gear pump 32 the pressure of the pressure oil delivered from the gear pump 32 can be increased to a sufficiently high value. Also, because the mating surfaces of the first, second and third housing pieces 48, 49, 51 are flat these outside surfaces can be easily formed with high accuracy, which allows easy formation of the gear pump 32.

Also as described above, the gears 37, 38 are formed with shaft holes 42, 51 on the axial centers 39, 41, and the support shafts 44, 45 are inserted in the shaft holes 42, 43. Therefore, since it is ensured that corners defined by the outside surfaces of the gears 37, 38 and the outside circumferential surfaces of the support shafts 44, 45 can be shaped to be right angular. Thus the corners of the opening ends of openings of the shaft holes 42, 43 into to the pumping cavity 36 are shaped to be right angular and the corners of the gears and those of the opening ends of openings of the shaft holes are fitted together, clearances between these corners can be significantly decreased compared with when they are formed into arcs and fitted together.

Therefore, partial return of pressure oil from the delivery side to the suction side through the foregoing clearances is prevented more reliably during operation of the gear pump 32, so that the pressure of the pressure oil delivered from the gear pump 32 can be increased to a sufficiently high value.

Also as described above, gears 37, 38 and support shafts 44, 45 are rotatable relative to their axial centers 39, 41, and coupling means 58 is provided for coupling the gears 37, 38 and the support shafts 44, 45 without fixing to each other such that said gears 37, 38 rotate with said support shafts 44, 45. Therefore little play is produced between the gears 37, 38 and the support shafts 44, 45, even if a forming error is produced in the degree of right angularity between the inside surfaces 46, 47 of the pumping cavity 36 and the axial centers 39, 41 of the support shafts 44, 45, this error is absorbed by the foregoing play, and the inside surfaces 46, 47 of the pumping cavity 36 can be brought close to the gears 37, 38 throughout their outside surfaces in close contact, so that clearances between the inside surfaces 46, 47 of the pumping cavity 36 and the outside surfaces of the gears 37, 38 can be significantly decreased.

Thus it should be readily apparent that a pump configured and manufactured as described provides a high output and compact configuration. Those skilled in the art will readily understand that the foregoing description is of preferred embodiments of the invention and that various changes and modifications may be made without departing from the spirit and scope of the invention, as defined by the appended claims.

What is claimed is :

1. An intermeshing gear pump comprised of an outer housing defining a pumping cavity in which a pair of intermeshing gears are journalled for pumping a fluid from a fluid inlet to said pumping cavity to a pumping outlet from said pumping cavity, said intermeshing gears having end faces at opposite sides of said gears extending perpendicularly to the rotational axes of said gears, said outer housing comprising a main body part and a pair of separate end plates affixed thereto, said main body part having an opening extending axially therethrough defining a portion of said pumping cavity facing the circumferential peripheral surfaces of said gears, said end plates each closing a respective side of said main body part opening and being in confronting relation to respective of said gear end faces for closing said pumping chamber, a grove is formed in only one side of the main body part communicating with said pumping cavity and closed by one of said end plates, said one end plate being formed with a fluid passage passing therethrough and communicating with said groove, and a fastener arrangement for affixing said end plates and said main body part together.

2. An intermeshing gear pump as set forth in claim 1 further comprising a check valved passage formed in the one end plate for providing one way fluid communication with the groove.

3. An intermeshing gear pump as set forth in claim 2 wherein a second fluid passage in the form of a second grove is formed in one side of the main body part communicating with the pumping cavity and is closed by one of the end plates and the one of the end plates is formed with a fluid passage passing therethrough and communicating with said second groove.

4. An intermeshing gear pump as set forth in claim 3 further comprising a check valved passage formed in the one end plate for providing one way fluid communication with the second groove.

5. An intermeshing gear pump as set forth in claim 4 wherein the groove and the second groove are formed in the same side of the main body part and are both closed by the same end plate.

6. An intermeshing gear pump as set forth in claim 1 wherein at least one of the gears is detachably supported on a shaft journalled by the end plates.

7. An intermeshing gear pump as set forth in claim 6 wherein the at least one of the gears forms a bore extending therethrough to receive the shaft, one end face of said one gear forming a slot extending perpendicularly to said bore, a coupling pin extending through said shaft and having at least one end portion received in said slot for non-rotatably coupling said shaft and said one gear.

8. An intermeshing gear pump as set forth in claim 6 both of the gears are detachably supported on respective shafts journalled in the end plates, each of said gears being formed with a bore extending therethrough to receive the respective shaft, one end face of each of said gears forming a respective slot extending perpendicularly to its bore, a pair of coupling pins each extending through a respective one of said shafts and having at least one end portion received in its slot far non-rotatably coupling the respective of said shafts and said gears.

9. An intermeshing gear pump as set forth in claim 1 wherein at least one of the end plates is in direct engagement with the respective gear end faces.

10. An intermeshing gear pump as set forth in claim 9 wherein both of the end plates are in direct engagement with the respective gear end faces.

11. An intermeshing gear pump comprised of an outer housing defining a pumping cavity in which a pair of intermeshing gears are journalled for pumping a fluid from a fluid inlet to said pumping cavity to a pumping outlet from said pumping cavity, said intermeshing gears having end faces extending perpendicularly to the rotational axes of said gears at at least one side of said gears, said outer housing comprising a main body part defining at least in part said pumping cavity and an end plate affixed thereto and closing said pumping cavity, at least one of said gears forming a bore extending therethrough to receive a shaft, said end face of said one gear forming a slot extending perpendicularly to said bore and of a depth less than the thickness of said one gear, a coupling pin extending through said shaft and having at least one end portion received in said slot for non-rotatably coupling said shaft and said one gear.

12. An intermeshing gear pump as set forth in claim 11 wherein at least one of the end plates is in direct engagement with the respective gear end faces for retaining the pin in the slot.

13. An intermeshing gear pump as set forth in claim 11 wherein both of the gears forming a bore extending therethrough to receive a shaft, one end face of each said gears forming a slot extending perpendicularly to the respective bore, a pair of coupling pins each extending through a respective of said shafts and having at least one end portion received in the slot thereof for non-rotatably coupling said shafts and said gears.

14. An intermeshing gear pump as set forth in claim 13 wherein at least one of the end plates is in direct engagement with the respective gear end faces for retaining the pins in the slots.

* * * * *